United States Patent [19]

O'Connor

[11] 4,063,852

[45] Dec. 20, 1977

[54] AXIAL FLOW IMPELLER WITH IMPROVED BLADE SHAPE

[75] Inventor: John F. O'Connor, Torrington, Conn.

[73] Assignee: Torin Corporation, Torrington, Conn.

[21] Appl. No.: 653,399

[22] Filed: Jan. 28, 1976

[51] Int. Cl.[2] ..... F04D 29/38

[52] U.S. Cl. ..... 416/228; 416/223 R

[58] Field of Search ..... 416/228, 223, 243

[56] References Cited

U.S. PATENT DOCUMENTS

| | | | |
|---|---|---|---|
| 995,562 | 6/1911 | Plewes | 416/223 |
| 1,088,883 | 3/1914 | Donath | 416/223 |
| 1,515,268 | 11/1924 | Morrow | 416/228 |
| 1,546,554 | 7/1925 | Ross | 416/223 |
| 1,688,809 | 10/1928 | Gill | 416/223 X |
| 1,855,660 | 4/1932 | Allen | 416/228 |
| 1,891,612 | 12/1932 | Schmidt | 416/223 X |
| 3,023,709 | 3/1962 | Kondo | 416/223 |

FOREIGN PATENT DOCUMENTS

| | | | |
|---|---|---|---|
| 115,470 | 12/1929 | Austria | 416/223 |
| 516,440 | 9/1955 | Canada | 416/223 |
| 74,292 | 12/1944 | CanalZone | 416/223 |
| 1,805,961 | 12/1969 | Germany | 416/223 |
| 99,717 | 8/1940 | Sweden | 416/223 |
| 228,177 | 7/1925 | United Kingdom | 416/228 |

*Primary Examiner*—Everette A. Powell, Jr.
*Attorney, Agent, or Firm*—McCormick, Paulding & Huber

[57] ABSTRACT

An axial flow impeller for low pressure ratio applications in the range 1.03 and below and comprising a hub carrying a plurality of similar circumaxially arranged air moving blades. Each blade has a root portion attached to the hub and a radially outwardly disposed tip portion. The camber of each blade decreases from root to tip with 0.1203 root camber and .023 tip camber for a ratio of 5.23 to 1. Pitch also decreases from root to tip with a root pitch of 46° and a tip pitch of 27.4° for a ratio of 1.68 to 1. Chord increases from root to tip with a 1.528 inch root chord and a 2.59 inch tip chord for a 1.7 to 1 ratio. The blade camber and chord both change gradually at the blade inner and mid portions with a 35% camber decrease in the outermost 20% of blade span, and with substantially all of the chord increase occurring beyond the blade midpoint.

23 Claims, 7 Drawing Figures

AXIAL FLOW IMPELLER WITH IMPROVED BLADE SHAPE

BACKGROUND OF THE INVENTION

A wide variety of blade shapes have been designed for use in low pressure applications of axial impellers over the years. Blade parameters such as camber, pitch, and chord have of course been varied in arriving at desired impeller performance characteristics. While a "cut and try" design technique has probably been most commonly employed more sophisticated design methods such as a "Free Vortex" design technique have also been used. The resulting blades and impellers have been generally satisfactory but one or more problems of excessive size, noise generation, vibration, etc. is usually encountered in operation.

SUMMARY OF THE INVENTION

It is the general object of the present invention to provide an optimum impeller blade design which represents a judicious compromise of design objectives such as minimum noise generation, small size and material economy.

DESCRIPTION OF PREFERRED EMBODIMENT

Figure 1:
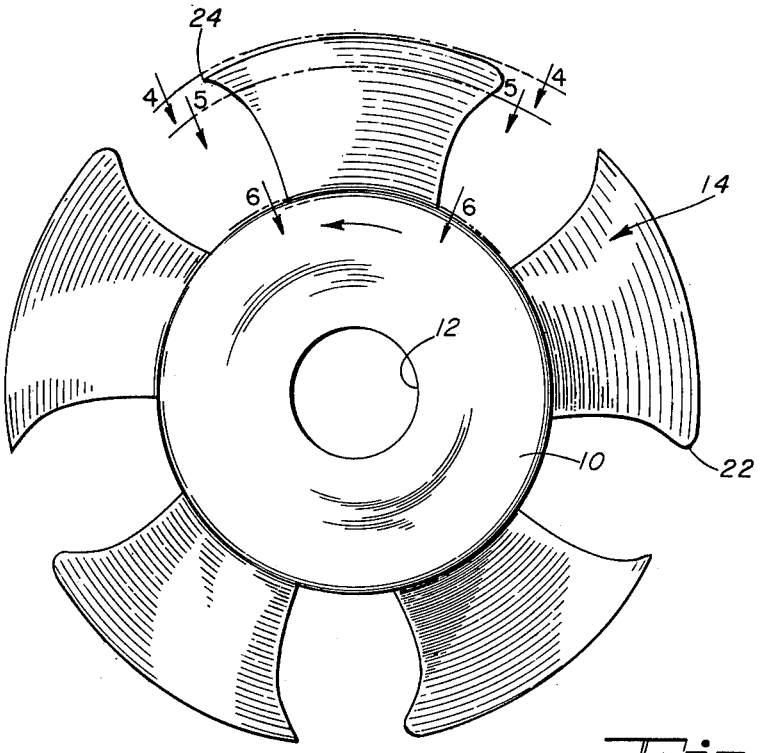
FIG. 1 is a front view of an axial flow air impeller constructed in accordance with the present invention.
Figure 2:
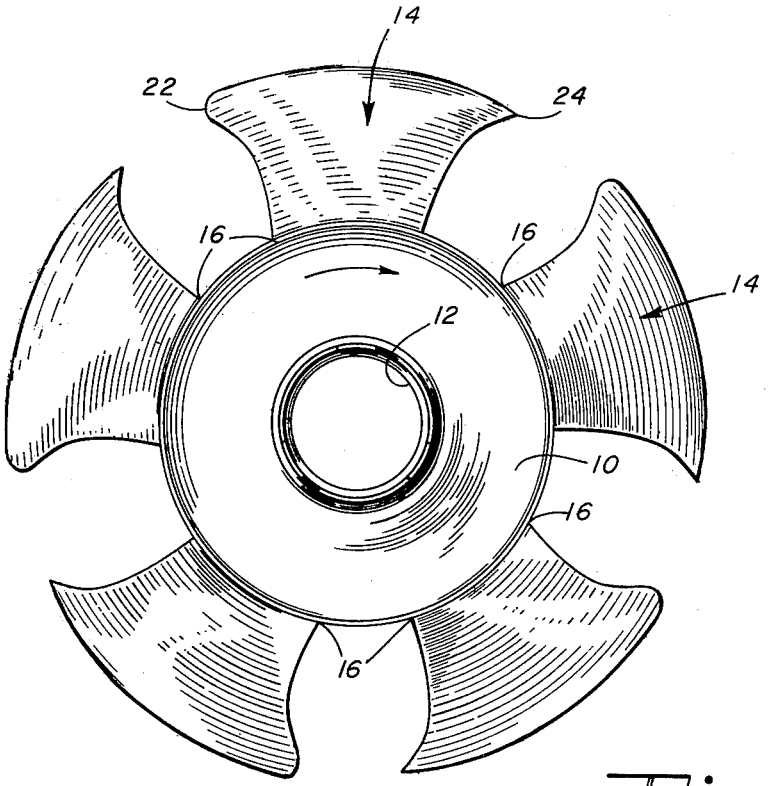
FIG. 2 is a rear view of the impeller of FIG. 1.
Figure 3:
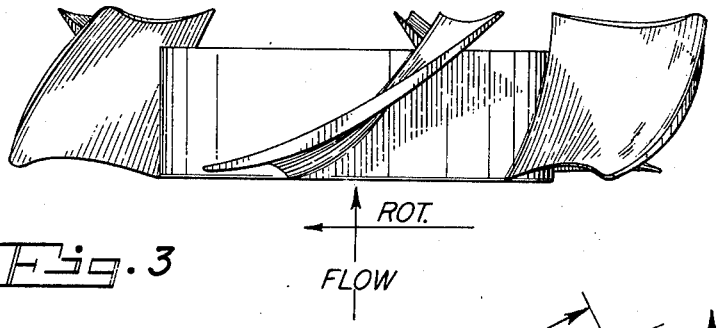
FIG. 3 is a top view of the impeller.

An axial flow impeller constructed in accordance with the present invention includes a hub and a plurality of similar circumaxially arranged air moving blades. Both the hub and the blades may vary widely in construction and the impeller shown in the drawings is to be regarded as an illustrative example only. The impeller shown is of molded thermoplastic construction but it will be obvious that materials of construction may also vary within the scope of the invention.

A hub 10 of the impeller shown in the drawings has a central opening 12 for mounting on an output shaft of an electrical motor or the like, and carries radially outwardly projecting air moving blades 14,14. Five (5) air moving blades are shown and the blades are formed integrally with the hub at radially inwardly disposed or "root" portions 16,16. The blade configuration may also vary within the scope of the invention but within limits as explained more fully hereinbelow.

As indicated above, blade configuration represents a judicious compromise of design objectives including minimization of noise generation, small size, and economy of material for given performance requirements. The design method employed is relatively sophisticated involving computer calculation and assignment of given increments of work to the various "spanwise slices" or increments of the blade in order to meet overall blade performance requirements. That is, the blades are designed with reference to blade "slices" or increments which extend across the blade and which are displaced one from the other varying radial distances from blade root to blade tip or in a "spanwise" direction, blade span being measured from root to tip. More specifically, the blades are so designed that a major portion of the required work is accomplished in intermediate portions of the blade, or throughout the "slices" or "increments" which are spaced some distance from the blade end portions. Blade root portions are unsuited to the assignment of a heavy work load as velocities in these regions are relatively low and, at the blade tip portions configurations which provide heavy work output also result in objectionable noise levels due to vortex interaction. In contrast, intermediate blade portions are favored with substantial velocity and thus capable of a relatively heavy workload. In a typical blade design in accordance with the present invention, the intermediate blade portion e.g. from 30% to 80% of blade span is designed to accomplished approximately 75% of the required overall work of the blade.

The treatment of the tip portions of the blades of the present invention is perhaps of greatest import in the analysis and design procedure. As mentioned, the assignment of a heavy workload to these blade portions and the resulting blade tip configurations entail objectionable noise generation. Particularly in the case of a shrouded impeller a complex vortex system exists in the region of the blade tip and results in a major portion of the high frequency noise generated by the blade. Accordingly, the tip portions of the blades, approximately the outermost 20% of blade span, are designed to provide a modest amount of work but consideration of noise generation, size, material economy are paramount in this region. Blade camber is sharply reduced beyond the blade midpoint and particularly toward the tip of the blade and the blade chord is shaprly increased in a similar region. In this manner, high frequency noise generation is sharply reduced, size and material conservation considerations are given due attention and yet the chord increase compensates at least in part for camber reduction and a modest but significant work output is achieved.

As will be apparent, a substantial root to tip change in camber and chord occurs in the blade configuration of the invention. In most instances blade pitch will also change viewed from root to tip and in the impeller shown all three parameters change in the root to tip progression. More particularly, blade camber decreases from root to tip for the blades 14,14, blade chord increases from root to tip, and blade pitch decreases, all within limits as set forth hereinbelow.

Figure 4:
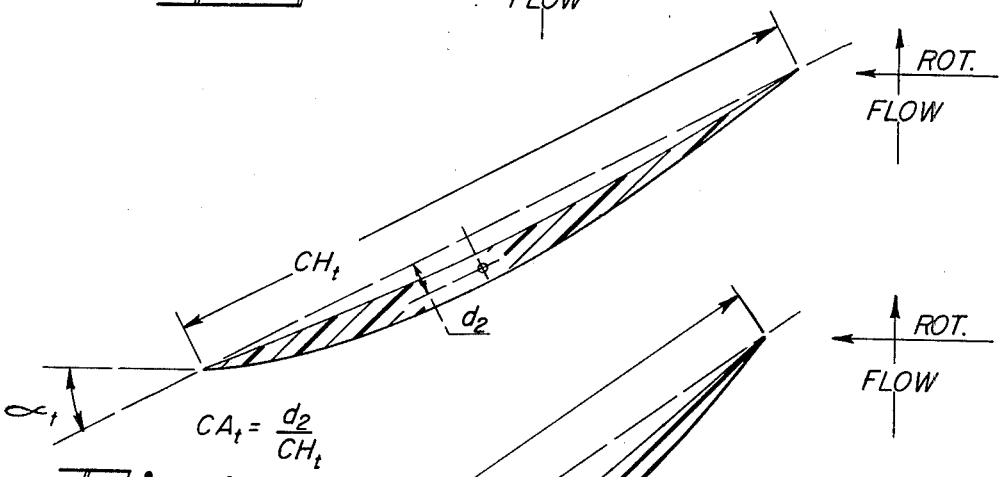
FIG. 4 is a sectional view through a tip portion of an impeller blade taken generally as indicated at 4—4 in FIG. 1.
Figure 5:
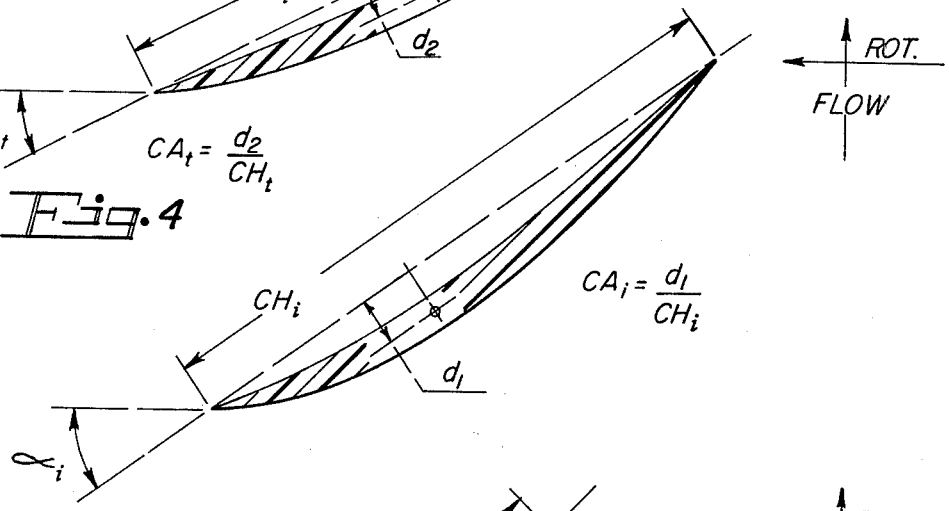
FIG. 5 is a sectional view through an intermediate portion of the blade taken generally as indicated at 5—5 in FIG. 1.
Figure 6:
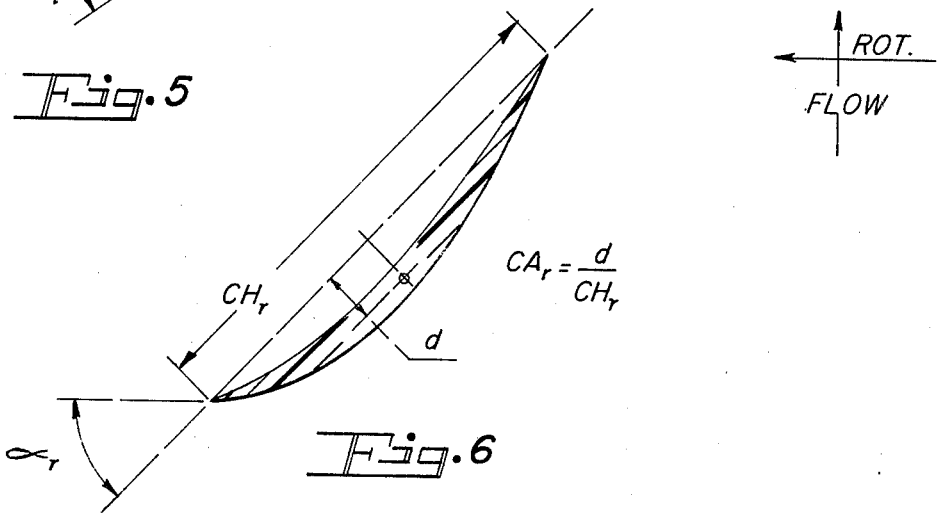
FIG. 6 is a sectional view through a root portion of the blade taken generally as indicated at 6—6 in FIG. 1.

The change in blade camber is perhaps most important to the success of the present design and should be within the following limits, all values being given for mean blade camber. Root camber $CA_r$ should fall in the range 0.15 to 0.1 and tip camber $CA_t$ in the range 0.020 to 0.040, with a maximum ratio of root to tip camber of 7.5 to 1 and a minimum ratio of root to tip camber of 2.5 to 1. The specific values for the blade design shown are 0.1203 for the root camber $CA_r$, FIG. 6, 0.023 for the tip camber $CA_t$, FIG. 4, and a ratio of 5.23 to 1. Camber $CA_i$ at an intermediate blade portion at approximately 80% blade span, FIG. 5, is 0.05.

Figure 7:
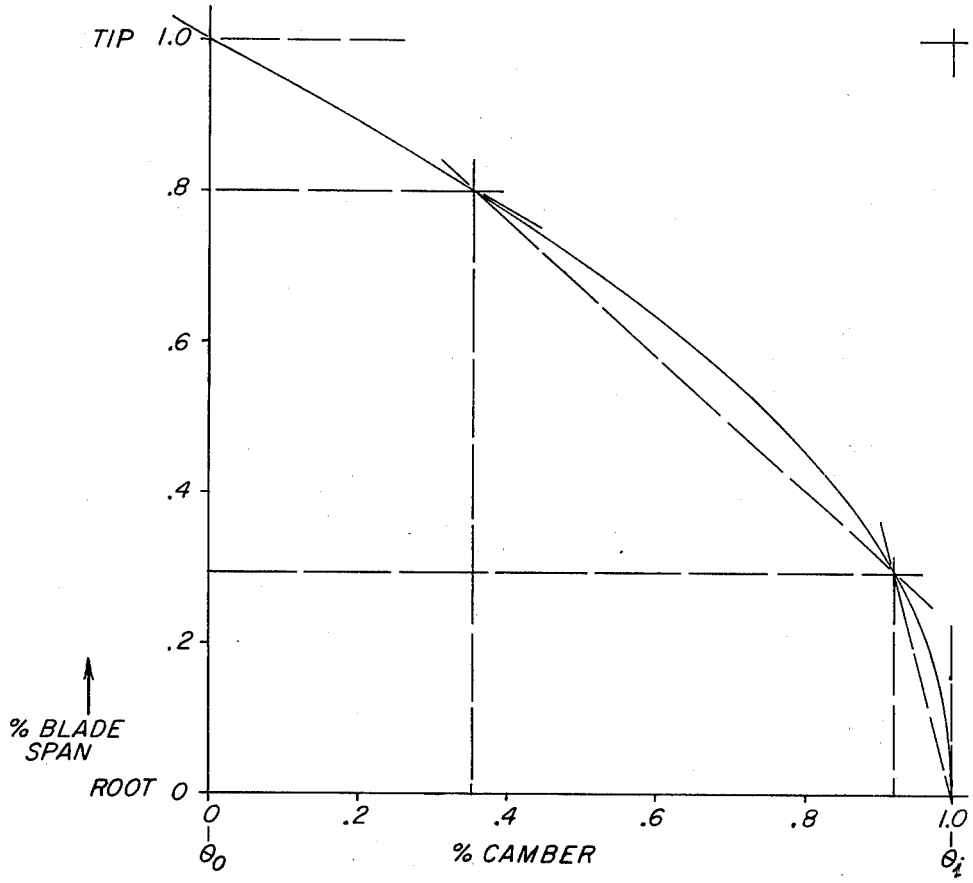
FIG. 7 is a plot of percent blade span versus percent camber.

Further, and with particular reference to FIG. 7, it is to be observed that camber decreases gradually for a first portion of each blade and that a sharp change in camber occurs at a second blade portion beyond the blade midpoint. The said second blade portion commences at approximately 70% to 90% of blade span and, more particularly, at approximately 80% of blade span measured from root to tip. In case of the blades 14,14 shown, approximately 35% of the overall camber change occurs in the final or outermost 20% of blade span, FIG. 7.

Further in accord with the invention, the increase in blade chord from root to tip is defined by a tip to root ratio which should not exceed 2.5 to 1. The lower limit of the tip to root ratio is 1.3 to 1 and the actual ratio for the blades 14,14 falls in the desired range at a value of 1.7 to 1, the blade tip chord $CH_t$ measuring 2.6 inches, root chord $CH_r$ 1.5 inches, and the intermediate chord $CH_i$, FIG. 5, measuring 2.2 inches. The aforementioned second or radially outwardly disposed blade portion is also characterized by a sharp increase in chord and at least 80% of the aggregate chord change occurs through the said blade portion. As will be observed with the blades 14,14 substantially all of the blade chord change occurs over the outermost 50% of blade span and, more particularly, over the outermost 30 to 40% of blade span.

While the specific plan form of the blades at the outermost region of maximum chord may vary within the scope of the invention, it is preferred to provide a gradual arcuate edge as at the trailing edges 22,22 of the blade 14,14. Other edge configurations are acceptable, however, as at the leading edges 24,24 of the blades 14,14 where a relatively sharp or pointed configuration is provided. The impeller shown is of the shrouded type and the sharp leading edges are determined by shroud configuration, the inlet side of the shroud being of a somewhat smaller diameter than the discharge side and the blades 14,14 conforming thereto. That is, the blade span or radial dimension is slightly reduced at the blade leading edge, thus somewhat sharpening an otherwise gradual arcuate edge.

Blade pitch may also vary from root to tip as mentioned and the limits of such variation as presently contemplated include a root pitch angle $\alpha_r$ between 30° and 70° and a tip pitch angle $\alpha_t$ between 10° and 20°. Pitch ratios presently regarded as optimum limits within the scope of the invention include a maximum variation of 7 to 1 from root to tip and a minimum ratio of 3 to 2. The root pitch angle $\alpha_r$ for the blades 14,14 is approximately 46°, FIG. 6 the tip pitch angle $\alpha_t$ approximately 27° and the intermediate pitch angle $\alpha_i$ approximately 29°. The actual ratio of root to tip pitch for the blades 14,14 is thus 1.7 to 1.

The results achieved with impeller blades constructed in accordance with the present invention include the minimization of size, noise generation and significant conservation of material for given blade performance requirements. With regard particularly to noise generation, a 5 to 6 decibel improvement on the USA Standards Institute or OSHA "A" Scale has been achieved with an impeller having blades of the present construction in comparison tests with an impeller having conventional blades of substantially constant camber, chord and pitch characteristics. An improvement in noise characteristics of such magnitude is regarded as an outstanding advance in the fan industry.

I claim:

1. An axial flow air impeller for low pressure ratio applications in the range 1.03 and below; said impeller comprising a hub adapted for rotation about an axis and carrying a plurality of similar circumaxially arranged air moving blades, each of said blades having a root portion attached to the hub and a radially outwardly disposed tip portion with smoothly curving side edges therebetween, the camber of each blade decreasing nonlinearly in value as the blade is viewed from its said root portion to its said tip portion, and the chord measurement of each blade being substantially less at its root portion than at its tip portion, substantially in excess of 50% of the blade camber decrease and substantially all of the blade chord change occuring over the outermost 40% of the blade span.

2. An axial flow air impeller as set forth in claim 1 wherein the camber at the root portion of each blade does not exceed 0.15 and the camber at the tip portion is at least 0.02.

3. An axial flow air impeller as set forth in claim 1 wherein the camber at the root portion of each blade is at least 0.1 and the camber at the tip portion does not exceed 0.04.

4. An axial flow air impeller as set forth in claim 1 wherein the ratio of camber at the blade root portion to camber at the blade tip portion is less than 7.5 to 1.

5. An axial flow air impeller as set forth in claim 1 wherein the ratio of camber at the blade root portion to camber at the blade tip portion is more than 2.5 to 1.

6. An axial flow air impeller as set forth in claim 1 wherein the ratio of blade root to tip camber is no higher than 7.5 to 1 and no lower than 2.5 to 1.

7. An axial flow air impeller as set forth in claim 1 wherein camber at the blade root portion is approximately 0.12 and camber at the blade tip portion is approximately 0.02.

8. An axial flow air impeller as set forth in claim 1 wherein the ratio of blade root to tip camber is approximately 5.2 to 1.

9. An axial flow air impeller as set forth in claim 1 wherein the pitch decreases from root to tip, and wherein pitch at the root portion of each blade does not exceed 70° and the pitch at the tip portion is at least 10°.

10. An axial flow air impeller as set forth in claim 9 wherein the pitch at the root portion of each blade is at least 30° and the pitch at the tip portion does not exceed 20°.

11. An axial flow air impeller as set forth in claim 9 wherein the ratio of pitch at the blade root portion to pitch at the blade tip portion is less than 7 to 1.

12. An axial flow air impeller as set forth in claim 9 wherein the ratio of pitch at the blade root portion to pitch at the blade tip portion is more than 3 to 2.

13. An axial flow air impeller as set forth in claim 9 wherein the ratio of blade root to tip pitch is no higher than 7 to 1 and no lower than 3 to 2.

14. An axial flow air impeller as set forth in claim 9 wherein pitch at the blade root portion is approximately 46° and pitch at the blade tip portion is approximately 27°.

15. An axial flow air impeller as set forth in claim 9 wherein the ratio of blade root to tip pitch is approximately 1.7 to 1.

16. An axial flow air impeller as set forth in claim 1 wherein the ratio of chord at the blade tip portion to chord at the blade root portion is less than 2.5 to 1.

17. An axial flow air impeller as set forth in claim 1 wherein the ratio of chord at the blade tip portion to chord at the blade root portion is more than 1.3 to 1.

18. An axial flow air impeller as set forth in claim 1 wherein the ratio of blade tip to root chord is no higher than 2.5 to 1 and no lower than 1.3 to 1.

19. An axial flow air impeller as set forth in claim 1 wherein the chord measurement at the blade root portion is approximately 1.5 inches and the chord measurement at the blade tip portion is approximately 2.6 inches.

20. An axial flow air impeller as set forth in claim 1 wherein the ratio of blade tip to root chord is approximately 1.7 to 1.

21. An axial flow air impeller as set forth in claim 1 wherein blade camber decreases from approximately 0.12 to approximately 0.02 over the root to tip blade span, and wherein blade chord increases by 60% to 80% over the root to tip blade span.

22. An axial flow air impeller as set forth in claim 1 wherein blade camber decreases approximately 35% over the outermost 20% of the root to tip blade span.

23. An axial flow air impeller as set forth in claim 1 wherein the blade side edges are substantially straight in the innermost 60% of the blade span and flare arcuately outwardly in the outermost 40% of the blade span.

* * * * *